United States Patent [19]

Tippy et al.

[11] B 3,995,899

[45] Dec. 7, 1976

[54] MICROWAVE OVEN INTERLOCK

[75] Inventors: Coy M. Tippy; David F. Graff, both of New Iberia, La.

[73] Assignee: Hobart Corporation, Troy, Ohio

[22] Filed: Feb. 14, 1975

[21] Appl. No.: 549,964

[44] Published under the second Trial Voluntary Protest Program on February 24, 1976 as document No. B 549,964.

[52] U.S. Cl. ..... 292/254; 292/DIG. 69

[51] Int. Cl.[2] ..... E05C 3/30

[58] Field of Search ..... 292/69, 254, DIG. 69; 70/32–42

[56] References Cited

UNITED STATES PATENTS 3,611,762 10/1971 McBurnie et al. ..... 292/254 X 3,733,456 5/1973 Blackburn ..... 219/10.55 C

*Primary Examiner*—Richard E. Moore

*Attorney, Agent, or Firm*—Biebel, French & Nauman

[57] ABSTRACT

A microwave oven interlock is provided to prevent oven operation when the oven door is opened or unlatched. An oven mounted strike is unlatched by lifting a handle mounted at the bottom of the door to allow the door to open upwardly. The interlock is responsive to the initial unlatching movement of the strike to disable the oven even before the door is unlatched. A cam arrangement on the hinges of the door senses the opening of the door to prevent further oven operation.

11 Claims, 5 Drawing Figures

MICROWAVE OVEN INTERLOCK

BACKGROUND OF THE INVENTION

The present invention relates to a unique safety interlock for microwave ovens. In microwave heating appliances, the nature of the heating phenomenon is that of stressing certain of the molecules of the products to be heated by using an electromagnet field, commonly in the heating frequency range of 2450 MHz. A problem with such devices has been concern about readiation leakage and the resulting possibility of serious injury to the operator. Because of this danger, the Department of Health, Education and Welfare, through the Bureau of Radiological Health (BRH), has promulgated a series of regulations specifying minimum safety precautions for microwave ovens manufactured or sold in the United States.

All such ovens are required to have a minimum of two safety interlocks. At least one safety interlock must be concealed and further, the concealed interlock is not to be operable by:

a. any part of the human body, b. any object with a straight insertable length of 10 centimeters, or c. a test magnet held in place on the oven by gravity or its own attraction." It is further required that "any visible actuating member of the concealed safety interlock must not be intended for removal by conventional tools without full or partial disassembly of the door and must have an apparent useful purpose and function other than interlock actuation unless access to the interlock is prevented when the door is open." Also it is required that a means of monitoring at least one of the safety interlocks be provided to cause the oven to become inoperable if the safety interlock should fail.

A number of interlocking devices have been developed for use with microwave ovens. Many of these devices, such as for instance those disclosed in U.S. Pat. Nos. 3,816,688; 3,715,554; 3,715,552; and 3,699,299, utilize a blade or latch member attached to the oven door for interlock actuation. The blade is positioned so as to be inserted into a slot in the oven cabinet when the door is closed. A switching mechanism within the cabinet is actuated by the presence of the blade and oven operation is thereby enabled.

Another approach taken to the interlock problem is disclosed in U.S. Pat. No. 3,784,776. The locking member disclosed therein is positioned within the cabinet of the oven and is physically moved into locking position by a solenoid. This movement of the locking member is sensed by means of a switch adjacent to the solenoid. Another solenoid actuated locking device is disclosed in U.S. Pat. No. 3,823,294. FIG. 6 of that disclosure shows an electromagnetically driven latch comprising a latching member having a hook for engaging the door and being pivoted by a solenoid. The position of the latching member is sensed by a switch.

Latches requiring large solenoids to move latching members are somewhat expensive and may require frequent service. Additionally since latching mechanisms are ordinarily susceptible to actuation when the oven door is opened, additional independent sensing means must necessarily be placed in the interlock circuitry to detect the opening of the oven door. A device for sensing the opening of the oven door is disclosed in U.S. Pat. No. 3,504,144.

SUMMARY OF THE INVENTION

In accordance with the present invention an interlock is provided for preventing operation of a microwave oven when the oven door is either opened or unlatched, in which a strike means for latching the oven door is mounted on the oven cabinet. A position sensing means for sensing the position of the oven door is further provided. A means for preventing operation of the oven is responsive to either the strike means being moved to unlatch the door or to the position sensing means indicating that the oven door is not closed. The position sensing means comprises a cam follower adjacent a cam fixed to the oven door. The cam is shaped to move the follower whenever the oven door is not fully closed, thereby actuating the means to prevent operation of the oven. Typically, the strike means is mounted on the oven cabinet beneath the opening leading to the cooking cavity, and is moved into latching or unlatching positions by a manually operable latch release means which is mounted in the oven door. The release means may comprise a latch bar movable in a single upward motion to release the oven door from interlocking engagement with the strike means initially and thereafter to open the oven door upwardly.

Accordingly, it is an object of this invention to provide a microwave oven interlock which prevents oven operation when the oven door is either unlatched or opened; to provide such an interlock mechanism in which a strike means is mounted on the oven cabinet and the means for actuating the strike means is contained within the oven door; and, to provide a microwave oven interlock in which any opening of the oven door is sensed by the position of a cam follower riding upon a cam surface which is fixed to the oven door.

Other objects and advantages of the invention will become apparent from the following description, the accompanying drawings and the appended claims.

DETAILED DESCRIPTION OF THE PREFERRED EMBODIMENT

Figure 1:
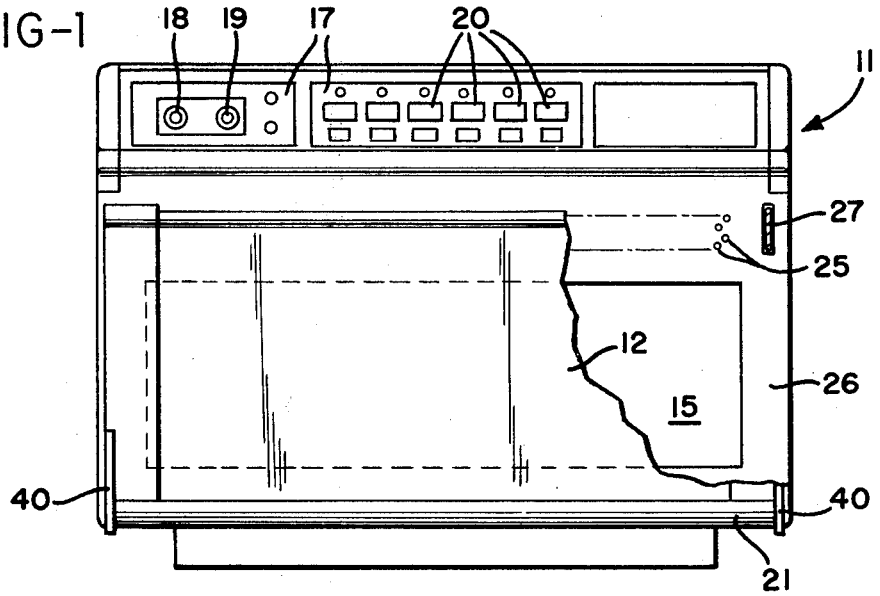
FIG. 1 is a front elevation view of a microwave oven with a portion of the door broken away.

Referring to FIG. 1, there is shown a microwave oven 11 having a door assembly 12 covering the opening of internal cooking cavity 15. The illustrated oven is equipped with one or more magnetrons delivering microwave energy in the band of 2450 MHz for rapidly reheating, cooking, or defrosting food. The controls 17 for oven 11 are mounted above the oven door and include an OFF switch 18 and an ON switch 19. The duration of a cooking cycle is set by operator contact with one of a series of touch plates 20. The body capacitance of the operator is sensed by timer circuitry connected to the touch plates, and the timer then causes the magnetrons to operate for the desired time. The oven door opens upwardly and is unlatched by the upward movement of latch bar 21. Door 12 conceals vent holes 25, but allows steam given off by the food being cooked to escape from the oven cavity 15 through the vent holes. The size of the holes is such that microwave energy will not be released through them. The oven door 12 overlaps the substantially flat front surface 26 of the oven cabinet to provide a barrier or seal to microwave radiation leakage. Slot 27 in the flat front surface 26 of the oven cabinet is provided to accept the door hinge which is thereby concealed when the door is closed.

Figure 2:
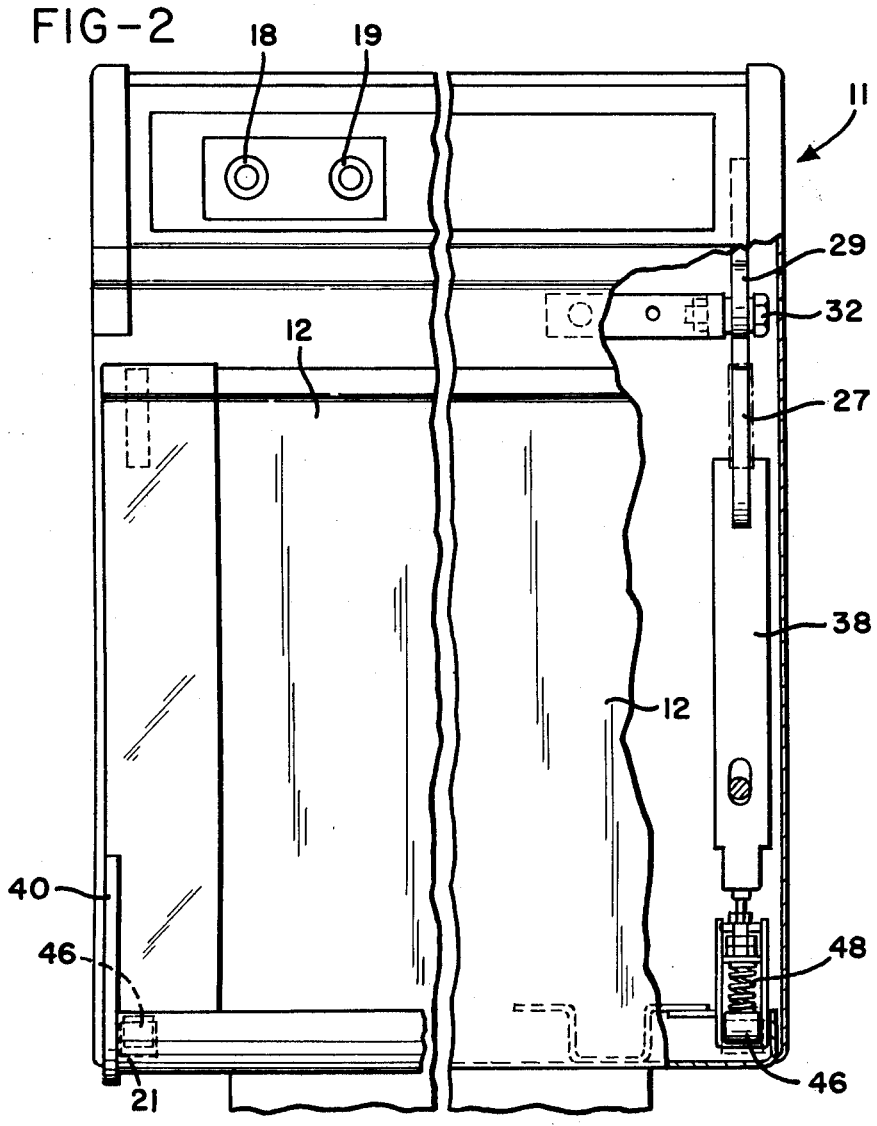
FIG. 2 is an enlarged view of the microwave oven shown in FIG. 1 with sections broken away to reveal internal structure.
Figure 3:
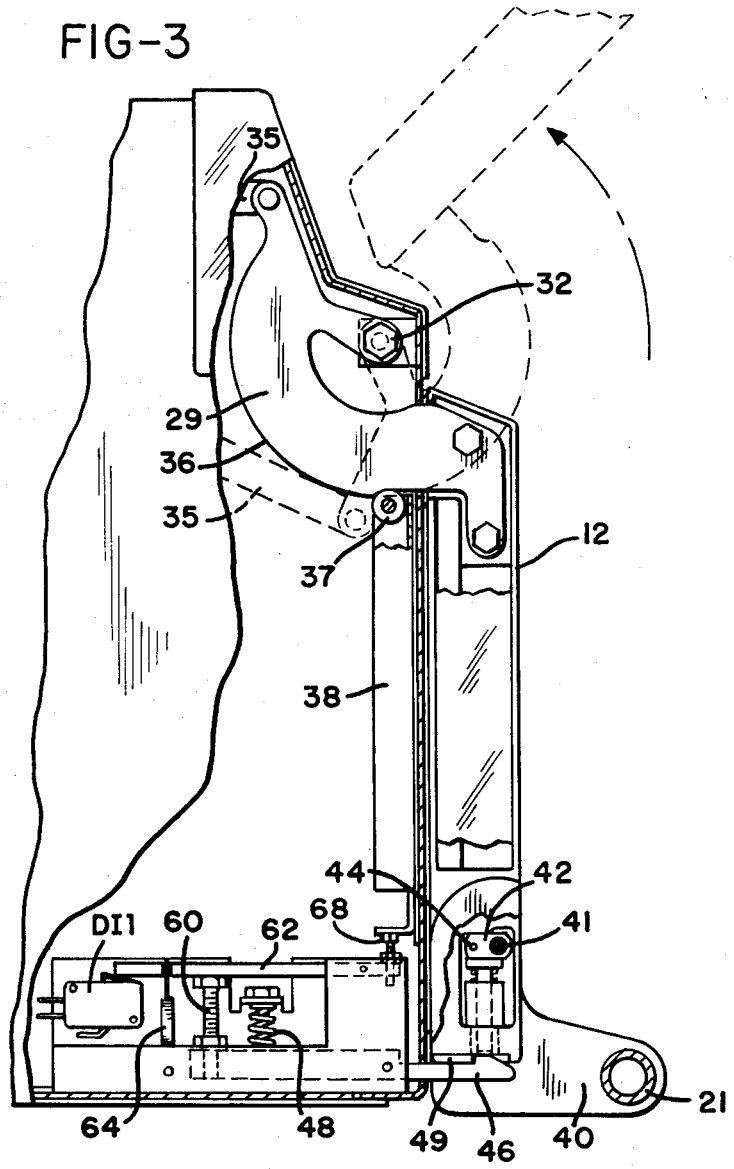
FIG. 3 is a partial side view of the oven with sections broken away to reveal internal structure.

Referring now to FIGS. 2 and 3, the oven door and cabinet are partially broken away to reveal the detailed structure of the interlock. The hinge and interlock arrangement for one end of the microwave oven door will be described but it is to be understood that an identical hinge and interlock arrangement is provided at both sides of the door, and further that either interlock is capable of disabling oven operation. Hinge 29 is fixed to oven door 12 and pivots about bolt 32 as shown by the dash lines in FIG. 3. The hinge 29 is also attached to linkage 35 to provide an overcenter action which aides in the opening and closing of the door. This is accomplished by means of a spring arrangement (not shown). Hinge 29 has a cam surface 36 upon which cam follower 37 rides. Cam follower 37 urges a plunger 38 downward whenever oven door 12 is opened.

Figure 4:
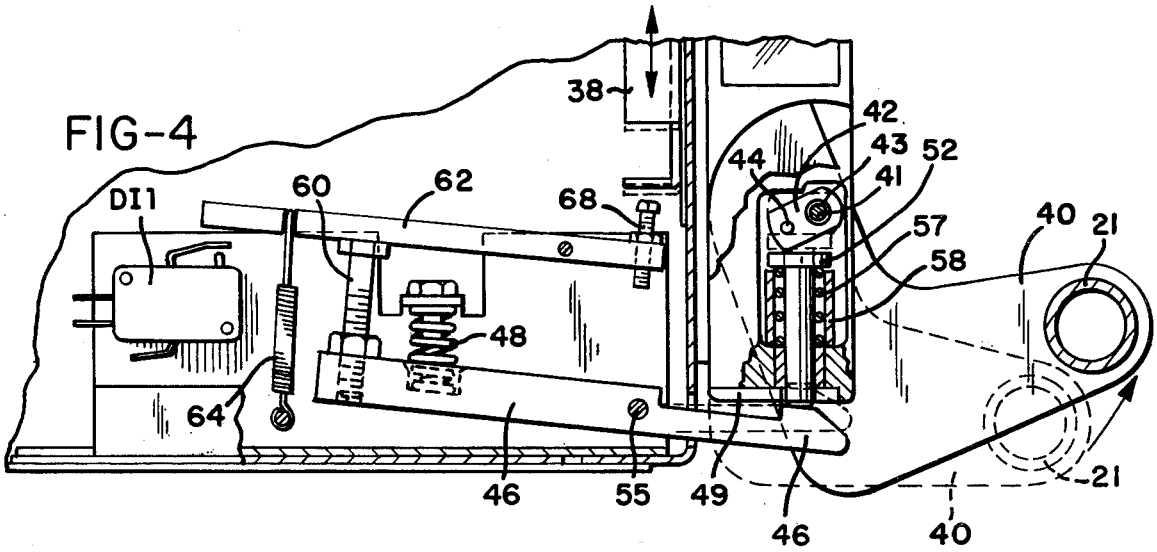
FIG. 4 is an enlargement of a portion of FIG. 3 with the relative movement of the interlock elements illustrated.

As shown in FIG. 1, latch pivot plates 40 are attached to the ends of latch bar 21. As shown in FIGS. 3 and 4, each latch pivot plate is mounted for rotation by screw 41 which extends through an appropriate hole in the plate and is threaded into a cam 42. The axis of rotation of the cam is along the center line of screw 41, and on that axis the cam has a short pin-like hollow projection 43 which engages within a counter-bored portion of the latch pivot plate hole (not shown). On the same axis at the opposite side of the cam there is a pin which projects into a bushing received in the door frame and thus provides for rotation of the cam on the axis of screw 41. A small pin 44 extends from the cam into a blind hole on the inside of the latch pivot plate, providing for concurrent rotation of the latch pivot plate and the cam. Strike means 46 is spring biased into a horizontal position as shown in FIGS. 2 and 3 by spring 48 and firmly latches the door closed by engaging plate 49.

Movement of strike means 46 to unlatch the door is accomplished by an upward rotation of latch bar 21 and plate 40 as shown in FIG. 4. This motion causes cam 42 to rotate and depress plunger 52. Plunger 52 in turn rotates strike means 46 about pivot point 55 thereby unlatching the door. The downward movement of plunger 56, which is accomplished against the force of spring 57 and limited by sleeve 58, forces strike means 46 out of engagement with plate 49.

The unlatching operation described above results in the rear end of the strike means 46 being raised, thereby causing adjustable member or bolt 60 to lift actuator bar 62. This upward motion of actuator bar 62 is accomplished against a mild spring force provided by spring 64 and results in the switch 66 being switched to a first switch position for disabling oven operation. Actuator bar 62 is normally biased by spring 64 to maintain switch DI1 in a second switch position in which oven operation is not prevented. The upward movement of bar 62 resulting from the door being unlatched is more than sufficient to be sensed by switch DI1 so oven operation is halted immediately when latch bar 21 is lifted. With precise length adjustment of bolt 60, oven operation can be halted by switch DI1 prior to the complete disengagement of strike means 46 from plate 49. When bolt 60 is properly adjusted, switch DI1 will be actuated by the movement of the strike means 46 into a third position intermediate a first position in which the oven door is engaged and a second position in which the oven door is released.

It is necessary to disable oven operation not only when the door is unlatched but also when the door is opened and the strike means has returned to its normal horizontal position. This is accomplished by means of the plunger 38, and cam follower 37 which cooperates with cam surface 36 on hinge 29. Whenever the door 12 is opened, plunger 38 is depressed sufficiently for it to contact bolt 68 fastened to actuator bar 62. The bolt 68 can be adjusted in length so that the plunger 38 accomplishes this downward movement at the very slightest opening of the oven door. The actuator bar 62 which was initially raised from contact with switch DI1 by the unlatching operation is therefore prevented from returning to its normal horizontal position. Switch DI1 thereby continues to disable oven operation. It should be noted that the plunger 38 does not raise the actuator bar 62 as great a distance off of switch DI1 as does the strike means 46. To do so would require such a sharp curvature change in the cam surface 36 that smooth operation of the hinge would be impeded. Since actuator bar 62 and spring 64 are separate from strike 46 and its biasing spring 48, a substantially greater spring force may be applied to strike means 46 to assure firm latching and yet allow cam follower 37 to operate under the lighter spring force of spring 64.

Figure 5:
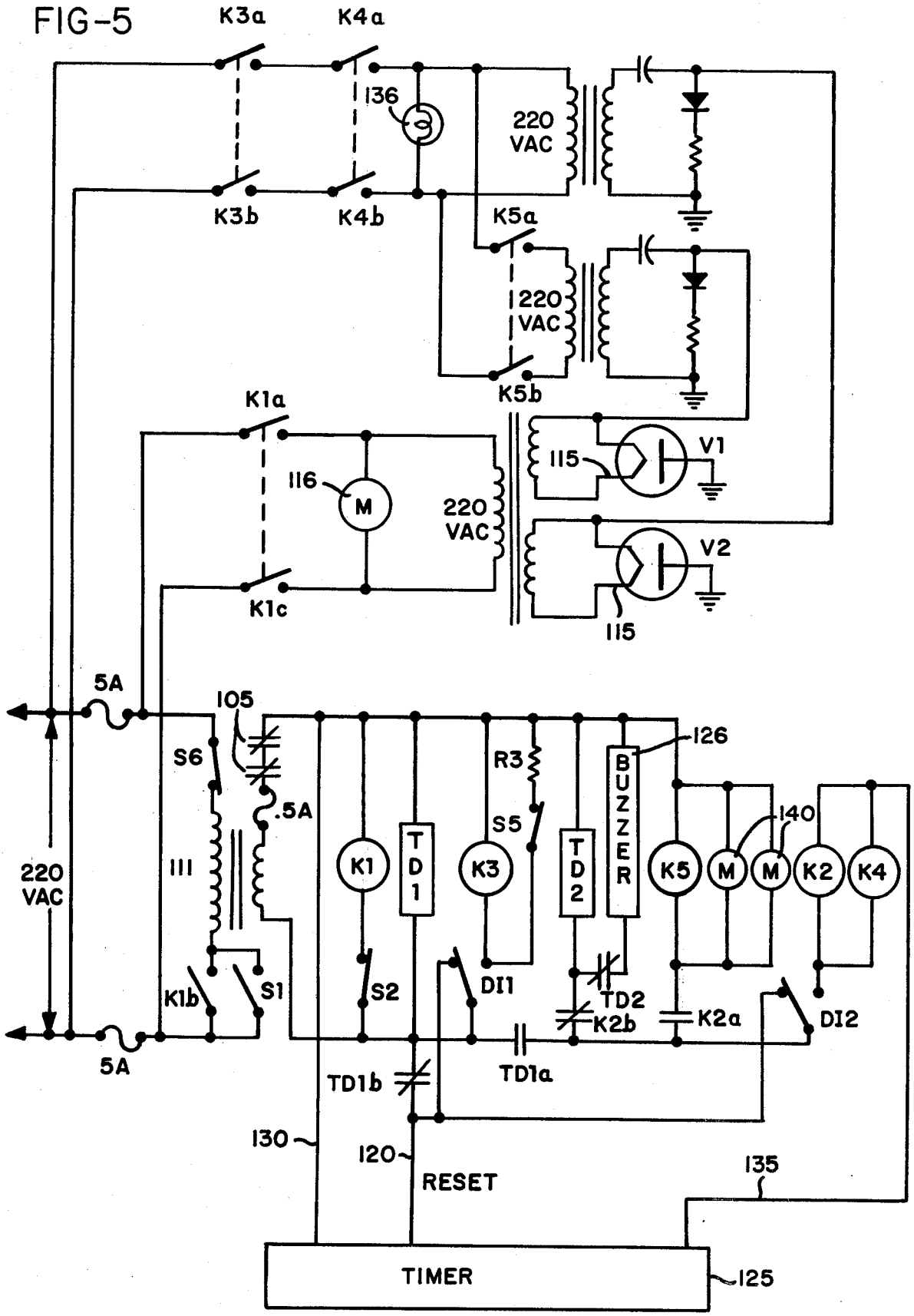
FIG. 5 is a schematic diagram illustrating a wiring arrangement which may be used with the interlock.

Referring now to FIG. 5 of the drawings, there is shown a schematic of the power control circuitry for a microwave oven utilizing the interlock of the present invention and having magnetrons V1 and V2. Switch S1 is the "ON" push button switch (normally open) and switch S2, is the "OFF" push button switch (normally closed), both of which are located on the oven control panel. Switch S6 is a switch located within the oven cabinet and opens to prevent oven operation only when the cabinet cover is removed. Switch S5 (normally open) is located on the over-center linkage of the oven door in such a manner as to close when the door is opened. Switches 105 are thermally responsive and open to prevent over-heating of magnetrons V1 and V2. The double throw switches DI1 and DI2 correspond to the door interlock switches described previously. These switches are arranged to be switched to their right position when the oven door is closed and to their left position when the oven door is opened.

The circuit operates in the following manner. Circuit operation is initiated when "ON" switch S1 is momentarily closed with the result that power is supplied to the secondary of transformer 111. Relay coil K1 is energized and its contacts K1*a*, K1*b*, and K1*c* are closed, locking the circuit on and supplying power to the magnetron heater filaments 115 and the blower motor 116. Timer TD1 is simultaneously activated and goes through a ten second delay, allowing the magnetron heater filaments 115 sufficient time to become properly heated. Providing that the oven door is closed, relay coil K3 is also energized through switch DI1 with the result that contacts K3*a* and K3*b* on the primary of the magnetron power circuit are closed. During this initial warm-up period, a reset signal on line 120 is applied to timer circuit 125 to prevent initiation of timer operation.

At the end of the ten second delay of timer TD1, contacts TD1*a* are closed and power is supplied to buzzer 126 indicating that a cooking cycle may now be initiated. The reset signal on line 120 is terminated by the opening of contacts TD1*b*. Timer TD2 is activated simultaneously with the buzzer 126 so as to terminate buzzer operation after a short period of time by opening contacts TD2.

The timer circuit 125 may then initiate a cooking cycle by connecting line 130 to line 135. This connection is maintained for a period of time set by means of switches on the oven control panel. Power is thus supplied to relay coil K4 by the timer circuit 125 through switch DI2. This in turn closes contracts K4*a* and K4*b* and magnetron VI begins operation. Lamp 136 lights to indicate this condition. Relay coil K2 is also energized, closing contacts K2*a*, so as to supply power to relay coil K5 and stirrer motors 140 a fraction of a second after power is supplied to relay coil K4. Contacts K5*a* and K5*b* are therefore closed and magnetron V1 is activated slightly after magnetron V2. This staggered initiation of magnetron operation is provided to prevent excessive surge currents which might result if both magnetrons were switched on simultaneously.

The duration of the cooking operation is then controlled by timer circuit 125. At the conclusion of the cooking cycle, power is removed from relay coils K2 and K4, thus opening contacts K2*a*, K4*a*, K4*b*, K5*a*, and K5*b*. Contacts K2*b* are closed causing the buzzer 125 to sound for the time period determined by timer TD2 to indicate that the cooking operation is completed.

It is clear that if either of the interlock switches DI1 and DI2 are switched to their left position, indicating the opening of the oven door during the cooking cycle, power will be immediately removed from both magnetrons by the opening of either contacts K3*a* and K3*b* or contacts K4*a* and K4*b*. Switch S5, which is mounted on the over-center oven door linkage, is used to monitor the operation of interlock switch DI1 and guard against its malfunction. If switch DI1 is defective and, as a result, assumes its right switch position when the door is opened, switch S5 will allow current to flow through resistor R3. Since this resistance is only 1.5 ohms, the 0.5 amp fuse in the secondary of transformer 111 will be blown. The oven will therefore become inoperable and will remain so until repaired.

While the forms of apparatus herein described constitutes a preferred embodiment of this invention, it is to be understood that the invention is not limited to these precise forms of apparatus, and that changes may be made therein without departing from the scope of the invention.

What is claimed is:

1. A microwave oven interlock for preventing oven operation when the oven door is open or unlatched comprising:

a cabinet with a front opening, a door covering said opening and hinged to said cabinet to move between a closed position covering said opening and an open position permitting access into the oven, strike means movably mounted on said cabinet for latching said oven door in its closed position with said strike means in a first position, disengagement means in said oven door for moving said strike means to a second position allowing said oven door to open, position sensing means for sensing the position of said oven door, and means, reponsive to said strike means moving to said second position, or to said position sensing means indicating that said oven door is not in said closed position, arranged to prevent operation of the oven.

2. The interlock of claim 1 wherein said position sensing means comprises:

a cam follower, and a cam fixed to said oven door in position to engage said follower and shaped to move said follower when said oven door is moved from said closed position.

3. The interlock arrangement of claim 2 wherein said means for preventing oven operation comprises:

switch means for disabling oven operation when in a first switch position and for allowing oven operation when in a second switch position, and an actuator bar normally biased to maintain said switch means in its second switch position and, responsive to the movement of said cam follower, or the movement of said strike means into its said second position, for moving said switch means into said first switch position.

4. The interlock of claim 1 wherein said position sensing means comprises:

hinge means, pivotally mounted to said cabinet and fixedly attached to said door, and further including a cam surface, and a cam follower positioned to engage said cam surface and movable by said cam surface when said oven door is moved from said closed position.

5. A safety interlock for a microwave oven having a cabinet and an oven door to prevent energization of the oven while the oven door is not completely closed, comprising:

strike means movably mounted on the cabinet and operative to latch the oven door, a cam surface attached to the door, a plunger, mounted on the cabinet, actuated by said cam surface, actuator means movable to a disabled position in response to the movement of said plunger, or to the movement of said strike means, and a switch responsive to the movement of said actuator means into said disabled position for preventing energization of the microwave oven.

6. A microwave oven interlock for a microwave oven, having an oven cabinet with an opening in the front of said cabinet leading to a cooking cavity within said cabinet and further having an oven door for covering said opening during cooking, said oven door being hinged to open upwardly, comprising:

strike means mounted on said oven cabinet beneath said opening and adapted to move into a first position for interlocking engagement with said oven door and into a second position for release of said oven door, switch means positioned to be actuated by the movement of said strike means into said second position for preventing oven operation, and manually operable latch release means mounted on said door for moving said strike means into its second position to allow said door to open upwardly.

7. The interlock of claim 6 further comprising means, responsive to the opening of said door, for actuating said switch means to prevent oven operation when said oven door is not closed.

8. The interlock of claim 6 wherein said release means comprises a latch bar movably mounted on said door and operable in a single upward motion to release said oven door initially from interlocking engagement with said strike means and thereafter to open said oven door upwardly.

9. A microwave oven interlock for a microwave oven, having an oven cabinet with an opening in the front of said cabinet leading to a cooking cavity within said cabinet and further having an oven door for covering said opening during cooking, said oven door being hinged to open upwardly, comprising:

strike means mounted on said oven cabinet beneath said opening and adapted to move into a first position for interlocking engagement with said oven door and into a second position for release of said oven door, switch means positioned to be actuated by the movement of said strike means into a third position intermediate said first position and said second position for preventing oven operation, and manually operable latch release means mounted on said door for moving said strike means from said first position through said third position and into said second position to allow said door to open upwardly.

10. The interlock of claim 9 wherein said strike means includes an adjustable member for actuating said switch means.

11. The interlock of claim 9 wherein said strike means includes a plurality of strikes mounted on said cabinet and wherein said switch means includes a plurality of switches, each switch being capable of preventing oven operation in response to the movement of an associated one of said plurality of strikes.

* * * * *